US005839306A

United States Patent [19]

Nunuparov

[11] Patent Number: 5,839,306

[45] Date of Patent: Nov. 24, 1998

[54] ELECTRONIC LOCK "CHIPLOCK"

[76] Inventor: Martyn Sergeevich Nunuparov, 1133-159, Zelenograd-Moscow, Russian Federation, 103460

[21] Appl. No.: 841,085

[22] Filed: Apr. 29, 1997

Related U.S. Application Data

[63] Continuation of Ser. No. 545,779, Nov. 9, 1995, abandoned.

[30] Foreign Application Priority Data

May 12, 1993 [RU] Russian Federation ..... 93027411/12

[51] Int. Cl.[6] ..... E05B 47/06

[52] U.S. Cl. ..... 70/283; 70/277

[58] Field of Search ..... 310/309; 70/283, 70/277, 282; 292/150

[56] References Cited

U.S. PATENT DOCUMENTS

| | | | |
|---|---|---|---|
| 315,186 | 4/1885 | Thaxter | 70/283 |
| 491,369 | 2/1893 | Moyer et al. | 292/150 |
| 4,656,850 | 4/1987 | Tabata | 70/276 |
| 4,754,185 | 6/1988 | Gabriel et al. | 310/309 |
| 4,912,460 | 3/1990 | Chu | 340/825.31 |
| 5,068,566 | 11/1991 | Culp | 310/328 |
| 5,229,679 | 7/1993 | Higuchi et al. | 310/328 |
| 5,378,954 | 1/1995 | Higuchi et al. | 310/309 |
| 5,430,597 | 7/1995 | Bagepalli et al. | 310/309 |
| 5,448,124 | 9/1995 | Higuchi et al. | 310/309 |
| 5,474,348 | 12/1995 | Palmer et al. | 292/339 |
| 5,487,289 | 1/1996 | Otto, III et al. | 70/279 |
| 5,534,740 | 7/1996 | Higuchi et al. | 310/309 |
| 5,541,465 | 7/1996 | Higuchi et al. | 310/309 |
| 5,552,654 | 9/1996 | Konno et al. | 310/309 |
| 5,629,578 | 5/1997 | Winger et al. | 310/334 |
| 5,631,514 | 5/1997 | Garcia et al. | 310/309 |
| 5,708,319 | 1/1998 | Ban et al. | 310/309 |

*Primary Examiner*—Steven N. Meyers
*Assistant Examiner*—Tuyet-Phuong Pham
*Attorney, Agent, or Firm*—Notaro & Michalos P.C.

[57] ABSTRACT

The invention provides an electronic lock, in which body (14) there is mounted a bar (1), a bar shifting mechanism including riegel (2), a control lever (3) and a blocking mechanism. The latter is made in form of an electromechanical catch which moving plate (11) is coupled to a limiter (8) blocking the bar shifting mechanism. In the present aspect of the electronic lock a power consumption is reduced significantly.

10 Claims, 3 Drawing Sheets

ELECTRONIC LOCK "CHIPLOCK"

This application is a continuation of application Ser. No. 08/545,779, filed Nov. 9, 1995, abandoned.

The invention relates to an automatic closure that uses fixing mechanisms and locking devices, and particularly to electronic locks for doors, safes, vehicles etc.

In known electronic locks a control element interacts with a lock bar most often by electromagnets which coils are supplied with electrical signal from enable means (USSR Author's Certificate No. 1694066, Int. Cl. E 05 B 47/00, published 1990).

A disadvantage of locks of this type is in a power coupling between the bar and the control element, which coupling is performed via a sufficiently powerful electromagnet. Because of a high consumed power of such lock it may operate only from external mains, or energy-intensive battery.

In another known electronic lock taken as a prior art, an electromagnet is employed only to deblock the bar and is turned on via a processor by a signal from an electronic key (U.S. Pat. No. 5,005,393, Int. Cl. E 05 B 47/00, published 1991).

However, even such a small electromagnet consumes a significant power and in the case of an autonomous power source, it requires to be periodically recharged or replaced thus deteriorating the lock performance.

SUMMARY OF THE INVENTION

This invention provides for many times reduction a power consumed by the electronic lock.

For this purpose in an electronic lock comprising a bar, a bar shift mechanism, and a blocking device; said blocking device is made in the form of an electromechanical catch including interactive elements mounted with the possibility of their mutual shifting and of their electroadhesive fixing and said blocking device is coupled to a limiter blocking the shift of said bar.

The Applicant does not know locking devices and more particularly electronic locks having the same set of essential features. This permits to consider the present invention being met the PCT criterion of novelty (N).

The Applicant knows systems in which the electroadhesive effect is employed for fixing processed details on a working plate (USSR Author's Certificates No. 1291395, Int. Cl. B 25 J 15/06, published 1987; No. 1320057, Int. Cl. B 25 J 15/06, published 1987; No. 1451000, Int. Cl. B 25 J 15/06, published 1989). However, the employing of the electro-adhesive effect to blocking elements mutually moved in mechanical devices and more particularly in door locks isn't known to the Applicant. This permits to consider the present invention being met the PCT criterion of inventive step (IS).

Reasons of an accordance of the present invention to PCT criterion of industrial applicability (IA) will be provided below.

BRIEF DESCRIPTION OF THE DRAWINGS

In a purpose of example a simplest variant of an electronic door lock is considered, thus illustrating clearly a technical aspect of this invention.

BEST EMBODIMENT OF THE INVENTION

Figure 1:
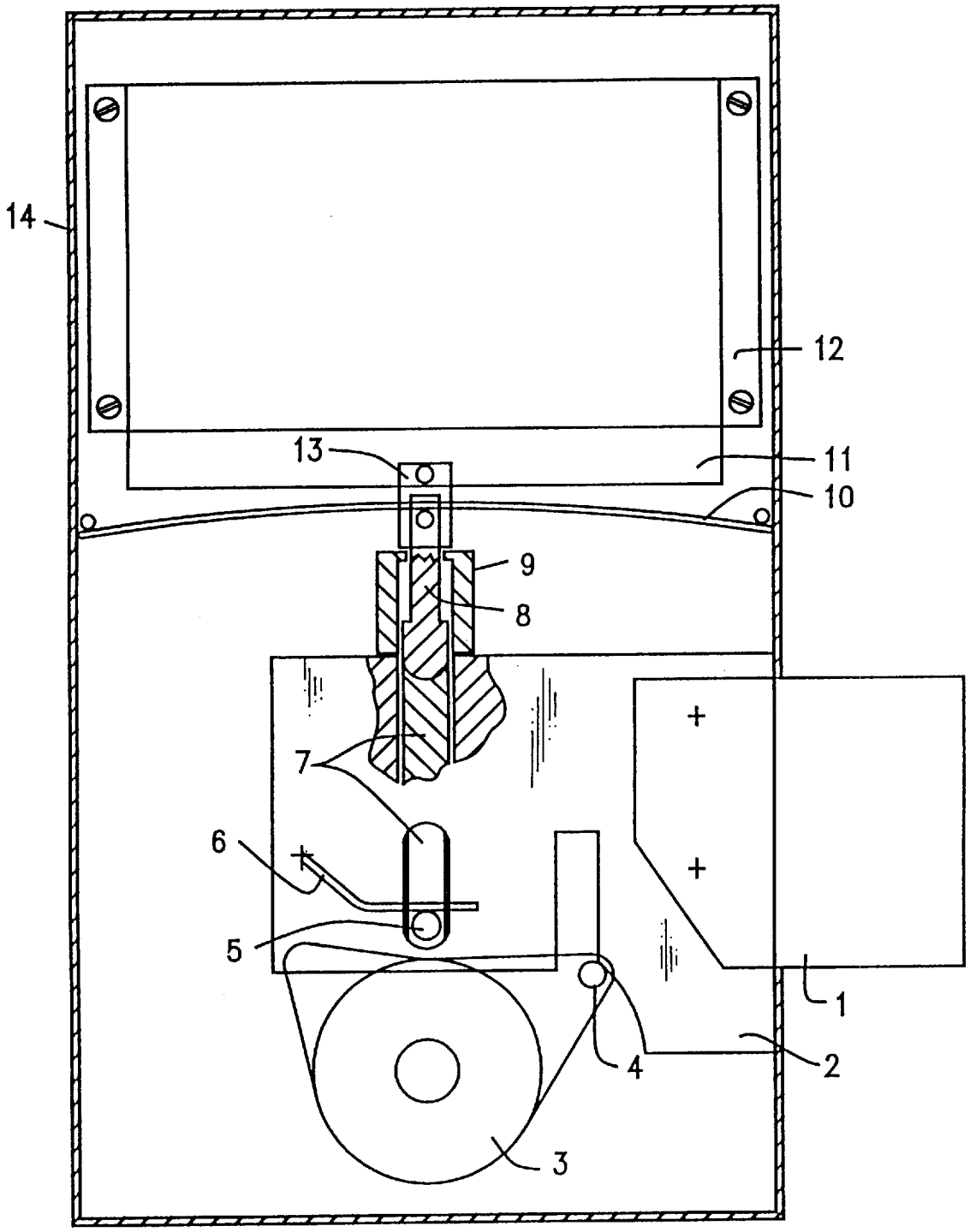
FIGS. 1 to 3 shows, in a schematical view, locations of main units of the electronic lock in different phases of its operating.

An embodiment of this invention will be described now with the reference to drawings.

An electronic lock includes a bar 1, a bar shift mechanism consisted of a riegel 2 and a control lever 3 having a dowel 4. A vertical hole (marked on the local cross-section) is made in a body of the riegel 2, in which hole a cylindric pin 7 is inserted having a transversal tip 5 going out of a slot in the lower plane part of the riegel 2. The pin 7 is under an effect of a returning spring 6 by means of the transversal tip 5. The bar shifting blocking device has a limiter 8 moved by the pin 7 and the spring 10 in a fixed bush 9 and coupled to a moving plate 11 of the electromechanical catch by a chain 13; a second plate 12 of the catch is fixed in a lock body 14.

Catch plates are divided by a thin dielectric clearance, and in the simplest case surfaces of that both plates, turned one to the other, are produced with a high polishing degree and have a conductivity. From the electrical point of view the catch is equivalent to a capacitor: once a voltage is applied on its plates they are charging by opposite polar charges. As known from the background art and particularly from the above mentioned references, the electrostatic attraction arises between the charged plates leading, under some condition, to a considerable mutual adhesion of these plates, that is so called electroadhesive interaction. In a shown schematic structure these catch plates are able to move mutually and their mutual location may be fixed at an arbitrary moment due to the electroadhesion, by applying an electrical charge to these plates.

FIG. 1 shows a starting state of the electronic lock mechanism. The bar 1 is slid out of the body 14 (the state of "lock is closed"), the limiter 8 of the blocking device is lowered into the vertical hole of the riegel 2 by the spring 10 thus blocking a shift of the bar 1.

Figure 2:
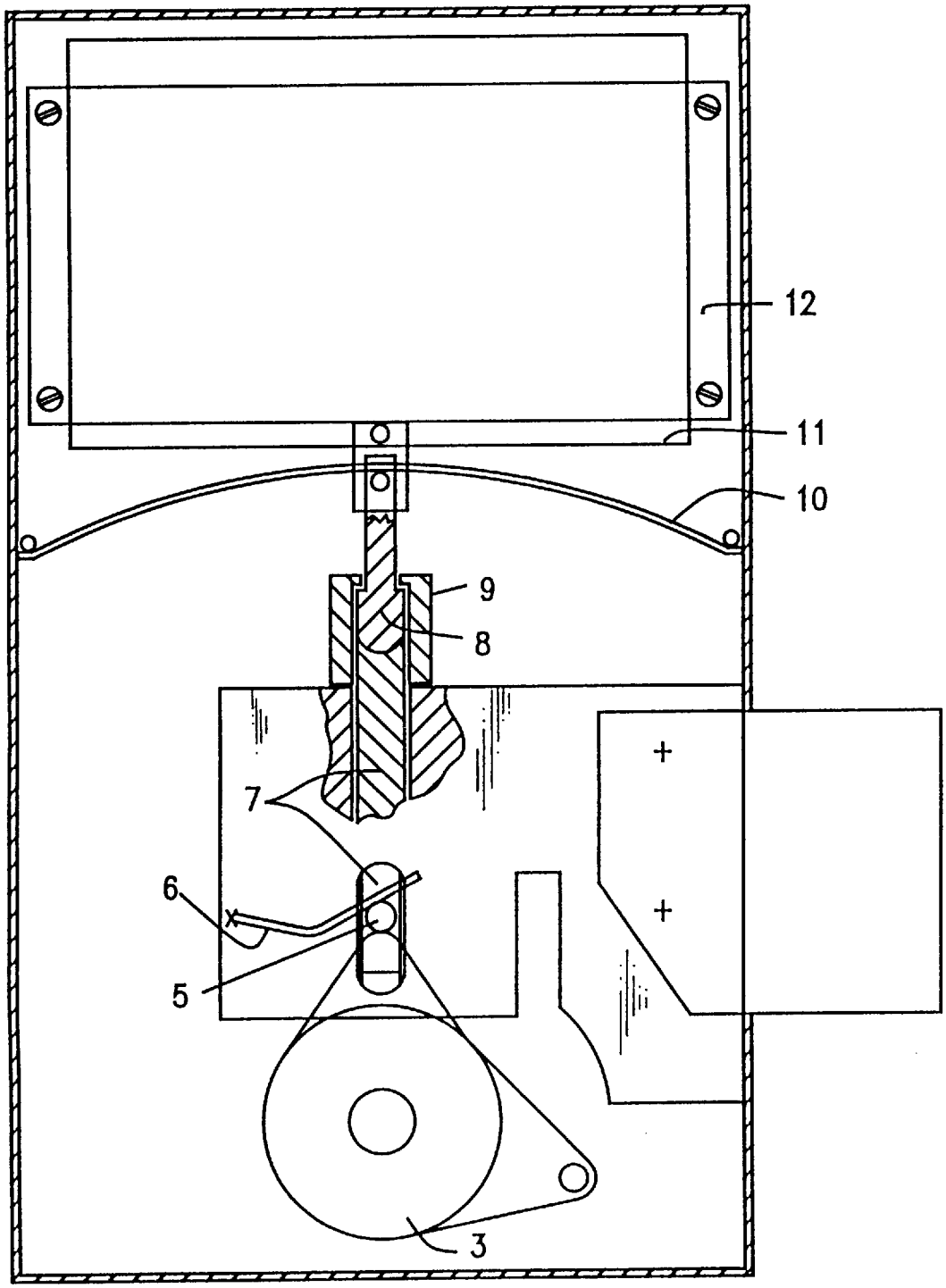

FIG. 2 illustrates "cocking" of the blocking device. When the control lever 3 is turned clockwise, its left cam forces the tip 5 and raises the pin 7 which in its turn raises the limiter 8. In the final position shown in the FIG. 2 the pin 7 comes into the fixed bush 9 thus operating as a limiter. The moving plate 1 of the electromechanical catch shifts away from its starting position with regard to the fixed plate 12.

After the control lever 3 is turned counter-clockwise to its starting position there are possible two version of the whole mechanism operation.

The first version, "idling", takes place when the catch plates 11, 12 are not supplied by the voltage. In this case an interaction between these plates is absent, and they are free in their mutual movement. The spring 10 lowers the limiter 8 after the pin 7 lowered to its starting position (FIG. 1).

The second version, "deblocking the lock", takes place when the catch plates 11, 12 are supplied by the voltage big enough for such an electroadhesive coupling of plates that counteracts a force of the tensed spring 10 and thus keeps the limiter 8 in a "cocked" state. The pin 7 is being hid by its returning spring 6 into the vertical hole of the riegel 2 enabling it to shift longitudinally.

Figure 3:
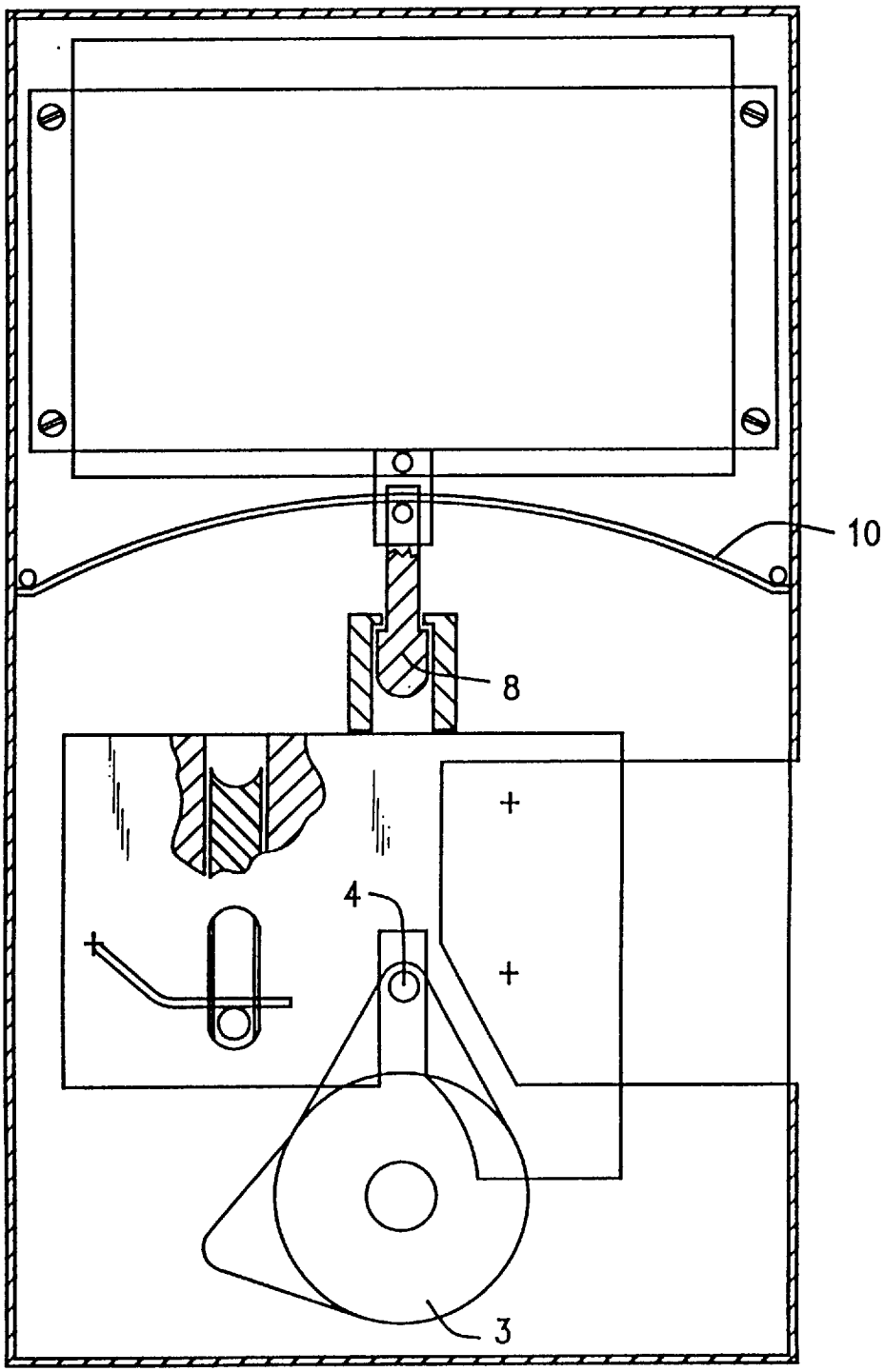

FIG. 3 shows the final state of the lock mechanism. The bar 1 is drawn into the lock body 14 (the state of "lock is open"). The longitudinal shift of the bar riegel 2 is performed by the dowel 4 of the control lever 3 acting onto the vertical slot of the riegel 2.

This reciprocating motion of the riegel 2 and the bar 1 is possible till the limiter 8 is in the "cocked" position. If the voltage maintaining the electroadhesive coupling of catch plates is removed then the spring 10 returns the blocking mechanism to its starting state at the moment when the vertical hole of the shifted riegel 2 comes under the limiter 8.

Industrial applicability

As follows from the given description this invention may be used as the electromechanical blocking mechanism in automatic systems and particularly for its proper purpose, i.e. as an electronic lock for doors of premises, safes, vehicles, etc.

A simple design of the discussed electronic lock allows to produce it in a large-scale production. In addition a use of the electroadhesive effect based on electrostatic interaction of mechanism elements for blocking the mechanisms requires much smaller power consumption unlike of the use of the electrodynamic interaction in known blocking mechanisms having electromagnetic coils.

So this invention allows to use the piezoelectricity (and the triboelectricity, or other types and methods of a quasi-static charge accumulation) to supply electronic locks having electroadhesive blocking devices.

It will be obvious to those skilled in the art that the above description is only one of possible embodiments.

In plural possible design versions the described lock elements: the bar, the bar shifting mechanism, methods for mechanical blocking of the bar shifting mechanism by means of the limiter, the form and the constructions of electroadhesive catch elements etc., may differ.

So, the above mentioned example of the electronic lock implementation is only an illustration and does not limit in any case the scope of this invention as defined in the claims appended hereto.

What is claimed is:

1. An electronic lock comprising:

a body;

a bar arranged shiftably disposed in said body between an open position and a closed position;

bar shifting means for transmitting an external mechanical force to said bar located in said body;

blocking means for blocking said bar shifting means, said blocking means being disposed of in said body and comprising a blocking element capable of taking one of a blocked position and deblocked position, and a return spring coupled with the blocking element;

fixing means for fixing said blocking element in one of the blocked position and deblocked position, the fixing means being kinematically coupled with said blocking element; and said fixing means being formed by two elements, the first element secured in said body and the second element slidably mounted along a surface of said first element for fixing said blocking element in one of the blocked and deblocked positions under the action of friction forces arising between the first and second elements of the fixing means when an static electric charge is applied once to the first and second elements.

2. The lock according to claim 1, wherein the first element and the second element of said fixing means are each provided with a corresponding terminal electrically connected to an external source of electric power for applying or removing an electric charge.

3. The lock according to claim 1, wherein the bar shifting means comprises a cam having at least two pushers for deblocking the bar shifting mechanism and for shifting the bar, respectively, and a handle for transmitting an external mechanical force to said bar shifting mechanism, the handle being kinematically coupled with the cam.

4. The lock according to claim 1, wherein the blocking element disposed in a guide bushing secured to the body.

5. The lock according to claim 1, wherein said first and second elements of the fixing means are in the form of plates.

6. The lock according to claim 1, wherein said first and second elements of the fixing means move longitudinally with respect to each other when sliding.

7. The lock according to claim 1, wherein said bar is mounted capable of reciprocation.

8. The lock according to claim 1, wherein said body is separable and comprises at least two body elements, the first body element positioning said bar and said bar shifting means within the body, and the second body element being kinematically coupled with the first body element and positioning the blocking means and fixing means within the body.

9. The lock according to claim 2, wherein the external source of electric power comes from piezoelectric elements or triboelectric elements.

10. The lock according to claim 9, wherein the mechanical power source is the external mechanical force applied to said bar shifting means.

* * * * *